US007123161B2

(12) United States Patent
Jeffryes et al.

(10) Patent No.: US 7,123,161 B2
(45) **Date of Patent: *Oct. 17, 2006**

(54) METHOD AND APPARATUS ENHANCED ACOUSTIC MUD PULSE TELEMETRY

(75) Inventors: Benjamin Peter Jeffryes, Histon (GB); Keith Alan Moriarty, Houston, TX (US); Sandra Denisse Reyes, Cambridge (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 611 days.

This patent is subject to a terminal disclaimer.

(21) Appl. No.: 10/203,367

(22) PCT Filed: Mar. 9, 2001

(86) PCT No.: PCT/GB01/01034

§ 371 (c)(1),
(2), (4) Date: Jan. 13, 2003

(87) PCT Pub. No.: WO01/66912

PCT Pub. Date: Sep. 13, 2001

(65) Prior Publication Data

US 2003/0151978 A1 Aug. 14, 2003

(30) Foreign Application Priority Data

Mar. 10, 2000 (GB) ..... 0005746.3
Jun. 9, 2000 (GB) ..... 0014031.9

(51) Int. Cl.
*G01V 8/14* (2006.01)

(52) U.S. Cl. ..... 340/854.3; 367/83; 367/85

(58) Field of Classification Search ..... 340/853.1, 340/853.8, 854.3, 856.3; 367/82, 84; 175/40, 175/48

See application file for complete search history.

(56) References Cited

U.S. PATENT DOCUMENTS

| | | | |
|---|---|---|---|
| 4,590,593 | A | 5/1986 | Rodney |
| 4,733,233 | A | 3/1988 | Grosso et al. |
| 4,878,206 | A | 10/1989 | Grosso et al. |
| 5,146,433 | A | 9/1992 | Kosmala et al. |
| 5,459,697 | A | 10/1995 | Chin et al. |
| 5,535,177 | A | 7/1996 | Chin et al. |
| 5,583,827 | A | 12/1996 | Chin |
| 5,969,638 | A | 10/1999 | Chin |

FOREIGN PATENT DOCUMENTS

| | | | |
|---|---|---|---|
| EP | 0 617 196 | A2 | 3/1994 |
| GB | 2 147 722 | A | 5/1985 |
| GB | 2 247 905 | A | 3/1992 |
| GB | 2 281 424 | A | 3/1995 |
| GB | 2 290 320 | A | 12/1995 |
| GB | 2 333 787 | A | 8/1999 |

*Primary Examiner*—Wendy R. Garber
*Assistant Examiner*—Hung Q. Dang
(74) *Attorney, Agent, or Firm*—Steven Gahlings; Jody Lynn DeStefanis; Dale Gaudier

(57) ABSTRACT

A method and system for telemetry through a drilling fluid during drilling is disclosed. A reflector (110) is positioned downstream from the drilling mud pumps (80) and causes reflected pressure waves having the same pressure polarity as incident pressure waves traveling upwards. At least one pressure sensor (92) is positioned below the reflector (110) to sense pressure in the drilling fluid. The reflector can be a fixed orifice plate or an adjustable aperture.

31 Claims, 7 Drawing Sheets

METHOD AND APPARATUS ENHANCED ACOUSTIC MUD PULSE TELEMETRY

FIELD OF THE INVENTION

The present invention relates to the field of telemetry during borehole drilling. In particular, the invention relates to a method and apparatus for signal enhancement for acoustic mud pulse telemetry.

BACKGROUND OF THE INVENTION

It is known that the reception of acoustic telemetry signals travelling through the drilling fluid, often referred to as mud pulse telemetry becomes more difficult with increasing well depth, and with very viscous drilling fluids. Although some of the difficulty in signal reception is an inevitable consequence of the attenuation of the acoustic signal in its passage up the mud column, it is also impeded by the acoustic conditions at the top of the mud column inside the surface system.

The impeded acoustic conditions can take various forms, among these being reflections generated by equipment such as pulsation dampeners that reduce the received signal and noise from the mud pumps and other equipment that interferes with the signal.

Because of signal attenuation and impeded acoustic conditions in the surface system, the telemetry signal can often be degraded to a point where conventional mud pulse telemetry is either impossible or impractical.

U.S. Pat. No. 5,146,433 describes methods for recovering a LWD or MWD data signal in the presence of mud pump noise and generally comprises calibrating the mud pump pressure as a function of the mud pump piston position and then tracking the piston position during transmission of the LWD or MWD data signal and using the calibration information to subtract out the mud pump noise. However, a disadvantage of this type of method is that it requires a measurement of the mud pump piston position and fails if the pump noise changes after calibration.

U.S. Pat. No. 4,590,593 describes an electronic noise filtration system for use in improving the signal to noise ratio of acoustic data transmitted from a downhole transducer in a measurement while drilling system. It uses a delayed difference between two acoustic receivers to increase the signal to noise. A disadvantage of this type of system is that it does not adapt to changing acoustic conditions, and therefore the performance will ordinarily degrade over time.

U.S. Pat. No. 5,969,638 describes a system and method for signal processing of MWD signals. It uses multiple receivers with an optimised separation and with specified delays before combination to reduce the pump noise. However, a disadvantage of this type of arrangement is that all the receivers have similar signal to noise ratio.

SUMMARY OF THE INVENTION

Thus, it is an object of the present invention to provide a system and method for enhanced acoustic mud pulse telemetry wherein the acoustic conditions at the top of the surface system is improved.

According to the invention a borehole communication system for telemetry through a drilling fluid is provided. The system includes a drilling fluid source configured to supply drilling fluid under pressure through a conduit towards a drill bit. A pulser is provided in the borehole configured to generate pressure pulses in the drilling fluid corresponding to a predetermined pattern.

A reflector is positioned downstream from the drilling fluid source dimensioned so as to cause in response to an incident pressure wave travelling from the pulser towards the surface, a reflected pressure wave having the same pressure polarity as the incident pressure wave.

A pressure sensor is positioned downstream of the reflector adapted to sense pressure in the drilling fluid and generate electrical signals corresponding to the sensed pressure.

According to a preferred embodiment the pressure sensor is positioned at least 12 pipe diameters downstream of the reflector. According to a more preferred embodiment the sensor is positioned at least 60 pipe diameters downstream of the reflector. According to a preferred embodiment a processor is provided in electrical communication with the pressure sensor to demodulate the electrical signals generated by the pressure sensor.

According to a preferred embodiment, the energy of an incident pressure wave absorbed by the reflector is greater than 20%. According to a more preferred embodiment the energy absorbed is greater than 30%. According to an even more preferred embodiment the energy absorbed is greater than 40%.

According to a preferred embodiment the reflector has a value of $\lambda_l$ (as defined herein) of greater than about 0.25. More preferably $\lambda_l$ is greater than 0.5, and even more preferably greater than one.

The reflector can be a fixed orifice plate, although according to a preferred embodiment an adjustable aperture is used.

According to another embodiment of the invention, a combination of the reflector and a multiplicity of pressure sensors are used, in combination with a processor that combines the signals from the pressure sensors so as to improve the signal to noise ratio. At least one of the pressure sensors is preferably placed upstream of the reflector.

The invention is also embodied in a method for detecting telemetry signals travelling from a downhole source towards the surface through a drilling.

DETAILED DESCRIPTION OF THE INVENTION

Figure 1:
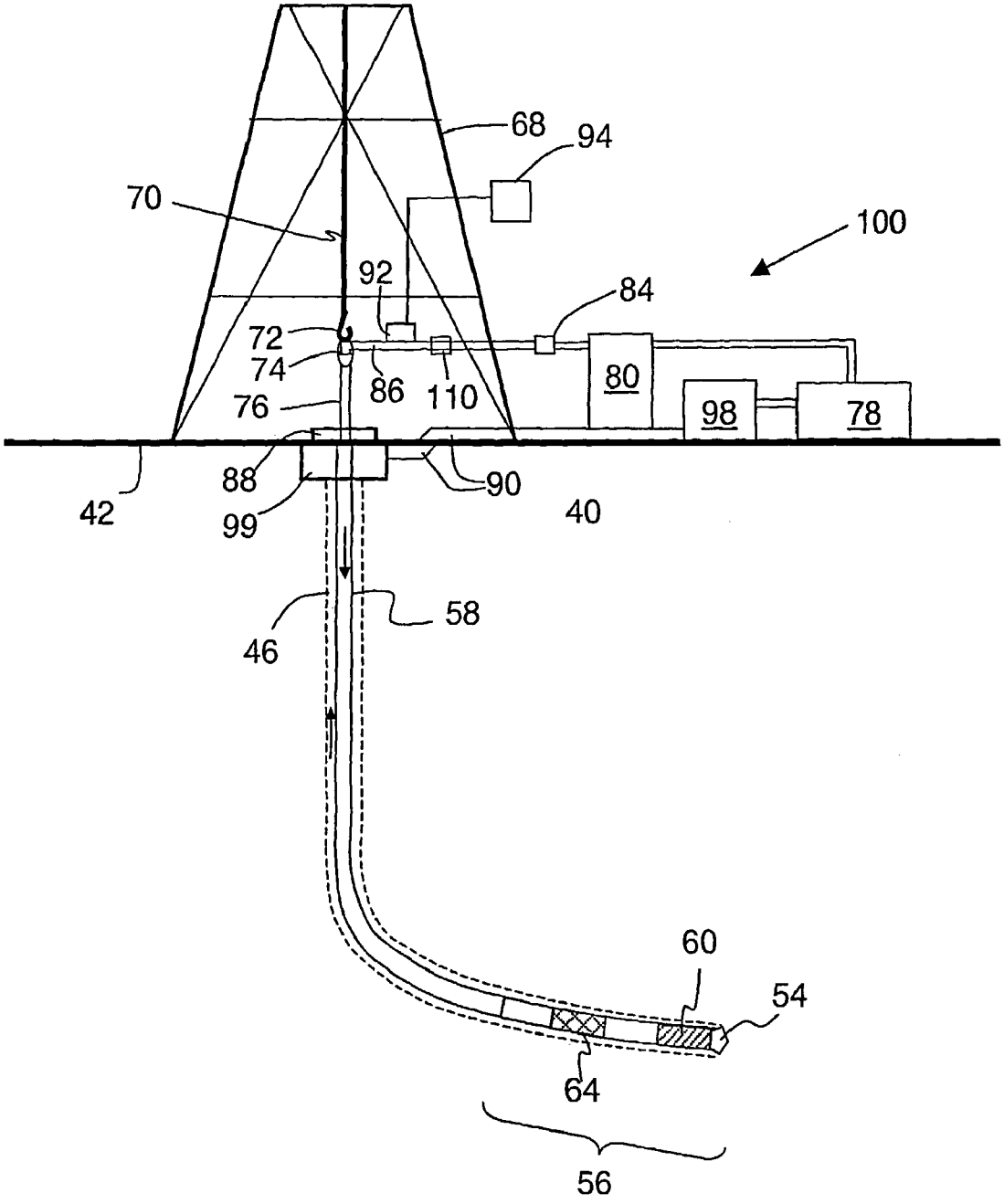
FIG. 1 shows a system for enhanced acoustic mud pulse telemetry during drilling, according to a preferred embodiment of the invention.

The following embodiments of the present invention will be described in the context of certain drilling arrangements, although those skilled in the art will recognize that the disclosed methods and structures are readily adaptable for broader application. Where the same reference numeral is repeated with respect to different figures, it refers to the corresponding structure in each such figure.

FIG. 1 shows a system for enhanced acoustic mud pulse telemetry during drilling, according to a preferred embodiment of the invention. Drill string 58 is shown within borehole 46. Borehole 46 is located in the earth 40 having a surface 42. Borehole 46 is being cut by the action of drill bit 54. Drill bit 54 is disposed at the far end of the bottom hole assembly 56 that is attached to and forms the lower portion of drill string 46. Bottom hole assembly 56 contains a number of devices including various subassemblies 60. According to the invention measurement-while-drilling (MWD) subassemblies are included in subassemblies 60. Examples of typical MWD measurements include direction, inclination, survey data, downhole pressure (inside and outside drill pipe), resistivity, density, and porosity. The signals from the MWD subassemblies are transmitted to pulser assembly 64. Pulser assembly 64 converts the signals from subassemblies 60 into pressure pulses in the drilling fluid. The pressure pulses are generated in a particular pattern, which represents the data from subassemblies 60. The pressure pulses are either positive (increases in pressure) or negative (decreases in pressure) or a combination of positive and negative pressure pulses. The pressure pulses travel upwards though the drilling fluid in the central opening in the drill string and towards the surface system. Subassemblies 60 can also include a turbine or motor for providing power for rotating drill bit 54.

The drilling surface system includes a derrick 68 and hoisting system, a rotating system, and a mud circulation system 100. The hoisting system which suspends the drill string 58, includes draw works 70, hook 72 and swivel 74. The rotating system includes kelly 76, rotary table 88, and engines (not shown). The rotating system imparts a rotational force on the drill string 58 as is well known in the art. Although a system with a Kelly and rotary table is shown in FIG. 1, those of skill in the art will recognize that the present invention is also applicable to top drive drilling arrangements. Although the drilling system is shown in FIG. 1 as being on land, those of skill in the art will recognize that the present invention is equally applicable to marine environments.

The mud circulation system 100 pumps drilling fluid down the central opening in the drill string. The drilling fluid is often called mud, and it is typically a mixture of water or diesel fuel, special clays, and other chemicals. The drilling mud is stored in mud pit 78. The drilling mud is drawn in to mud pumps 80 which pumps the mud though stand pipe 86 and into the kelly 76 through swivel 74 which contains a rotating seal. Between the mud pumps 80 and the stand-pipe 86 are placed pulsation dampeners 84 which serve to reduce the pressure fluctuations in the mud circulation system.

The mud passes through drill string 58 and through drill bit 54. As the teeth of the drill bit grind and gouges the earth formation into cuttings the mud is ejected out of openings or nozzles in the bit with great speed and pressure. These jets of mud lift the cuttings off the bottom of the hole and away from the bit, and up towards the surface in the annular space between drill string 58 and the wall of borehole 46.

At the surface the mud and cuttings leave the well through a side outlet in blowout preventer 99 and through mud return line 90. The mud is returned to mud pit 78 for storage and re-use.

According to the invention, a reflector 110 is provided in standpipe 86 downstream of the pulsation dampener 84. As will be described in greater detail below, reflector 110 acts to reflect pressure pulses traveling up through the drilling mud generated by pulser assembly 64. The mud pulses are detected by pressure sensor 92, located downstream of the reflector 110 in stand pipe 86. Pressure sensor 92 comprises a transducer that converts the mud pressure into electronic signals. The pressure sensor 92 is connected to processor 94 that converts the signal from the pressure signal into digital form, stores and demodulates the digital signal into useable MWD data. Although reflector 110 and pressure sensor 92 are shown located on the standpipe 86 in FIG. 1, they may also be provided in other locations downstream from the pulsation dampener 84.

Figure 2:
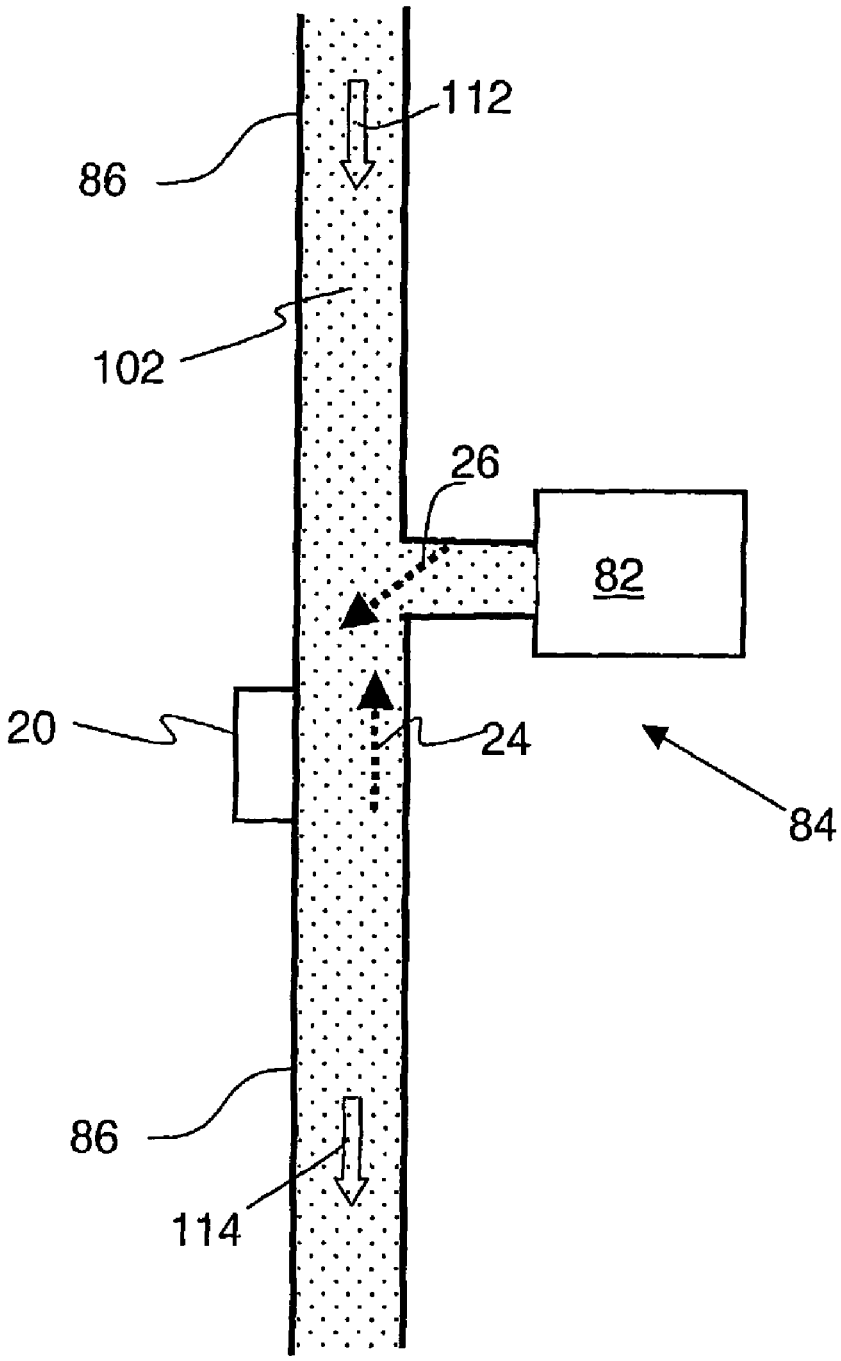
Figure 2 (prior art)
FIG. 2 shows a conventional mud pulse signal receiver arrangement according to the prior art.

FIG. 2 shows a conventional mud pulse signal receiver arrangement according to the prior art. Shown in FIG. 2 is a section of stand pipe 86 in the vicinity of the pulsation dampener 84. Mud 102 is flowing in a downward direction as depicted by flow direction arrows 112 and 114. Dampener 82 is typically provided to reduce pump wear by reducing fluctuations in pressure experienced by the pumps. It typically consists of a gas-pressurized bladder inside a rigid housing, although other configurations are employed.

An acoustic wave 24 travelling up the mud column is partially reflected at the pulsation dampener 84. The reflected wave 26 is shown travelling back from pulsation dampener 82. Importantly, the reflection coefficient of such reflections is frequently negative. Thus, polarity of the reflected wave 26 is opposite to incident wave 24. As a result of the reflection coefficient being negative in the vicinity of a pressure sensor 20 in this conventional arrangement, the pressure sensor 20 will tend to measure a reduced signal. This because the reflected wave 26 partially cancels out the incident wave 24.

Figure 3:
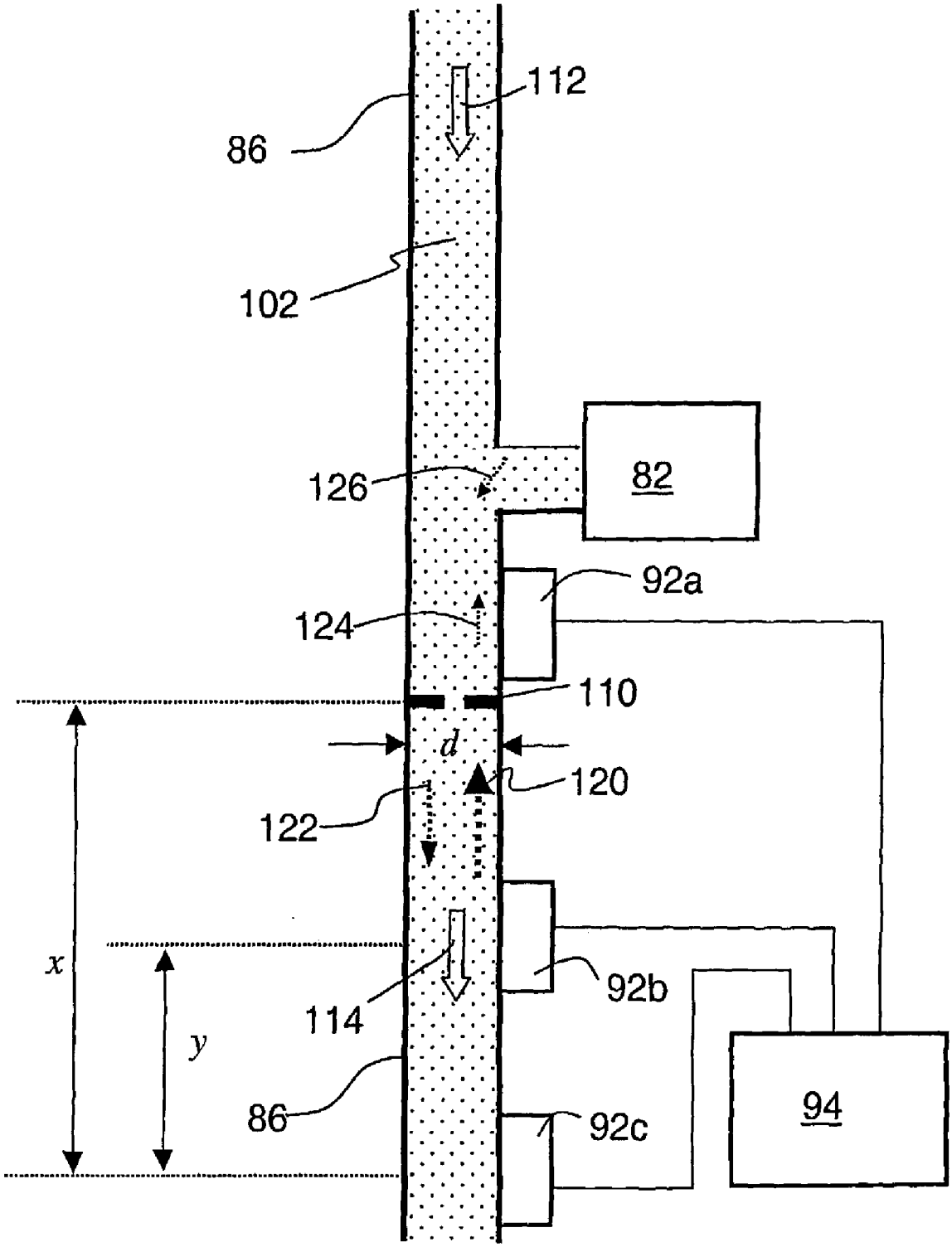
FIG. 3 shows a system for receiving mud pulse signals according to a preferred embodiment of the invention.

FIG. 3 shows a system for receiving mud pulse signals according to a preferred embodiment of the invention. The structure of standpipe 86, pulsation dampener 84 are as previously described with respect to FIG. 2 and will therefore not be repeated here. A reflector 110 is positioned within standpipe 86 at a location downstream from the pulsation dampener 84. The reflector 110 effectively reflects a portion of an incident pressure wave 120, shown as reflected wave 122, while allowing a portion of the pressure wave through, shown as pressure wave 124. The transmitted pressure wave 124 will then propagate towards the pulsation dampener 84 and be reflected. Reflected wave 126 is shown as the reflection of wave 124 from pulsation dampener 84. A portion of reflected wave 126 is then transmitted through the reflector 110.

Importantly, the polarity of the reflected wave 122 is the same as the incident wave 120. Additionally, the amount of energy passing back through the reflector (e.g. from wave 126) and having a polarity opposite to the incident wave 120 is much smaller than if reflector 110 were not present.

Advantageously, a pressure wave incident such as wave 120 is much more easily detectable on the downstream side of reflector 110. Pressure sensors 92*a–c* are shown in FIG. 3 located on both the upstream and the downstream side of reflector 110. According to a preferred embodiment three pressure sensors are provided. Sensors 92*a–c* detect the mud pressure pulses and comprises a transducer that converts the mud pressure into electronic signals. The pressure sensors 92*a–c* are connected to processor 94 that converts the signal from the pressure signal into digital form, stores and demodulates the digital signal into useable MWD data. Sensors 92*b* and 92*c* are provided downstream of the reflector 110 can detect an increased signal because of the positive reflection from the reflector 110. Additionally, noise coming from upstream of reflector 110 will be partially reflected back upstream, thereby reducing the noise level detected by sensors 92*b* and 92*c*. There may be frequencies at which the signal will be reduced due to other reflections in the surface apparatus, a phenomenon known as "fading". The fading will generally be for different frequencies at different locations. According to a preferred embodiment, multiple downstream sensors are provided so that when the output signals are appropriately combined in processor 94 the effects of fading can be reduced. Providing sensor 92*a* upstream of the reflector 110 allows for the detection of a signal having greater pump noise. According to a preferred embodiment, the output from sensors 92*a* can be combined with signals from one or more downstream sensors in processor 94 (e.g. 92*b* and 92*c*) in order to improve the overall signal to noise ratio. According to other embodiments of the invention, other numbers of sensors are provided. In particular providing fewer sensor has the advantage of saving cost and reducing complexity. For example, one upstream and one downstream sensor can be provided (e.g. 92*a* and 92*b*). Where it is impractical to provide an upstream sensor, two downstream sensors (e.g. 92*b* and 92*c*) can be provided. Where only one sensor is provided, it is placed downstream of reflector 110.

Figure 5:
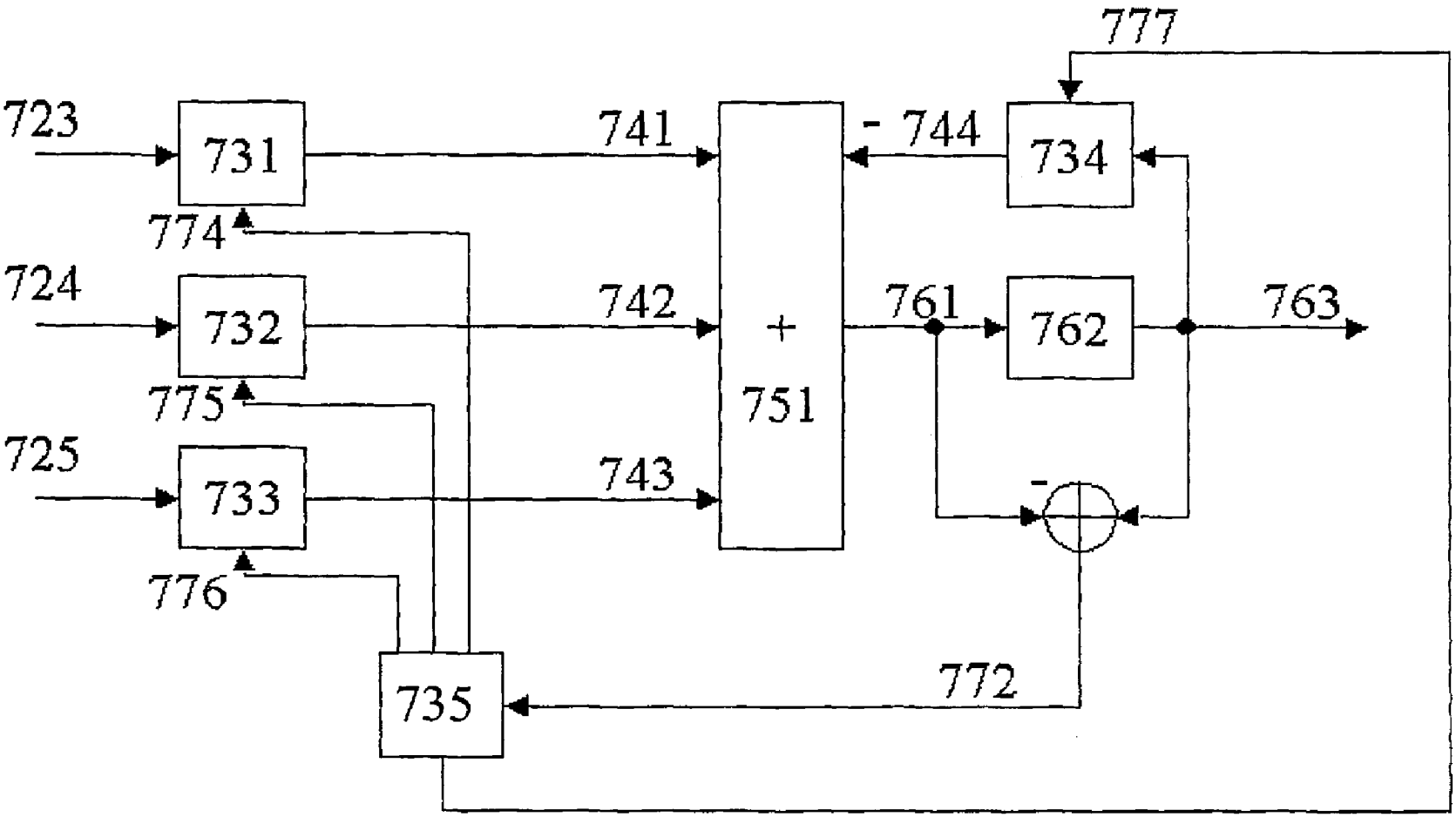
FIG. 5 is a block diagram showing a method for combining sensor output signals, according to a preferred embodiment of the invention.

Further detail of preferred methods of combining the output signals of the sensors 92*a–c*, will now be described. FIG. 5 is a block diagram showing a method for combining sensor output signals, according to a preferred embodiment. FIG. 5 shows a block diagram of processing that preferably takes place within processor 94. The inputs 723, 724, 725 represent digitized and complex baseband samples of the outputs signals from sensors 92*a*, 92*b*, and 92*c*, respectively. These inputs go into an adaptive multi-channel decision feedback equalizer, whose main components are adaptive forward filters 731, 732, 733 and an adaptive feedback filter 734.

Forward filters 731, 732, 733 are designed to mitigate the effects of frequency selective fading on the input signals 723, 724, 725. And the feedback filter 734 is designed to mitigate the effects of previously detected symbols on the current symbol, where a "symbol" is number of bits. The number bits per symbol depends on the modulation system used, and is commonly between 1 to 3 bits for mud pulse telemetry.

The output 744 of the feedback filter 734 is subtracted from the sum of the outputs 741, 742, 743 of the forward filters 731, 732, 733 in the summing operation 751. The combined output 761 of the summing operation, which is in general a complex number, is used as the input to detector 762. The detector 762 then makes a decision 763 about the symbol that was received. The decision is preferably based on maximum likelihood criterion, such as the minimum distance in the complex plane between output 761 and possible expected values for different symbols.

The coefficients of filters 774, 775, 776, 777 are jointly adapted by the adaptive algorithm 735 that is designed to minimize the mean squared error between the samples of the received signal and the detected output. This adaptive algorithm is driven by the error signal 772 obtained from the difference between the detector input 761 and the detector output 763.

Since the wavelength of the mud pressure pulses ordinarily used for borehole telemetry is relatively long, the pressure sensors 92*b–c* need not be located immediately downstream of reflector 110, but could be placed further downstream if such placement were more practical. Additionally, as discussed in further detail below, it is preferred that pressure sensor 92 be placed more than about 12 pipe diameters downstream of reflector 110. In the case of FIG. 1, the pipe diameter would be the diameter of standpipe 86. Even more preferably, pressure sensor 92 should be placed more than about 60 pipe diameters downstream from reflector 110.

According to a preferred embodiment, reflector 110 comprises a fixed orifice plate mounted on standpipe 86. The orifice acts as fixed choke in a hydraulic system, but also acts as a reflector in an acoustic system. The orifice thus provides a positive reflection coefficient to waves travelling both upstream and downstream, and also absorbs a proportion of the acoustic signal travelling through it.

Thus, by mounting a choke between the pulsation dampener 84 and pressure sensors 92*b–c* then the signal on those sensor will be enhanced. While there will be still be a negative reflection from the pulsation dampener, the amplitude of the wave incident on that interface will be reduced, and there will additionally be a positive reflection from the choke.

The pressure waves being reflected from reflector 110 can be mathematically described as follows. Let $$z_l = \frac{A_l}{c_l}$$

where $A_l$ is the cross-sectional area of the pipe below (or downstream of) the reflector and $c_l$ is the speed of sound below the reflector (similarly with subscript u for above (or upstream of) the reflector).

According to the invention a useful characteristic of reflectors, $\lambda_l$, is defined as:

$$\lambda_l = \frac{2\Delta}{\rho_l c_l V_l}$$

where $\rho_l$ is the density of the drilling fluid below the reflector, $\Delta$ is the mean pressure drop across the reflector and $V_l$ is the mean flow velocity below the reflector. Then the reflection coefficient from below of the orifice is given by $$R = \frac{\lambda_l - 1 + \frac{z_l}{z_u}}{\lambda_1 + 1 + \frac{z_l}{z_u}}$$

The transmission (in terms of pressure) is given by $$T = \frac{2\frac{z_l}{z_u}}{\lambda_l + 1 + \frac{z_l}{z_u}}$$

Thus, referring to FIG. 3, the pressure amplitude of wave 124 is T times the amplitude of incident wave 120, and the pressure amplitude of reflected wave 122 is R times the amplitude of incident wave 120.

$\lambda_l$ has been found as useful measure of the effectiveness of the reflector 110. In general, greater values of $\lambda_l$ for a reflector will result in better pressure signal detection. In practice the upper limit of $\lambda_l$ will be determined by the maximum available pump pressure, the other pressure drops in the drilling assemblies, and the required pressure in the annulus for a particular application. It is believed that useful pressure wave detection is provided even when $\lambda_l$ is in the range of 0.25. According to a more preferred embodiment, $\lambda_l$ should be greater than 0.5. If $\lambda_l$ is in the range of 0.5 or greater the pressure signal enhancement can be significantly improved in many applications. According to an even more preferred embodiment $\lambda_l$ is greater than 1. It is believed that if $\lambda_l$ is greater than about 1 the reflector 110 also can provide a significant reduction in the noise coming from the mud pumps.

The proportion of the energy in an incident wave 120 absorbed by the reflector 110 is given by:

$$A = \frac{4\lambda_l}{\left(\lambda_l + 1 + \frac{z_l}{z_u}\right)^2}$$

According to a preferred embodiment at least 20% of the energy of an incident pressure wave should be absorbed by reflector 110. According to an even more preferred embodiment, energy absorption of about 30% will provide a significant improvement in signal detection in many applications. According to an even more preferred embodiment, if the energy absorption by reflector 110 is greater than about 40%, a significant reduction in noise from the mud pumps can also be provided.

According to an alternative preferred embodiment, reflector 110 is an adjustable aperture, such as an adjustable choke, which is commercially available. By using an adjustable aperture, the effective values of $\lambda_l$ and energy absorption can be optimized for the particular conditions. For example, when low drilling fluid flow rates are being used, the size of the aperture can be decreased, thus enhancing signal reception, and when high flow rates are required, the aperture can be increase so as to stay within the maximum pumping capacity.

Although the reflector increases the signal strength, it can itself generate noise. The stream of fluid issuing from the small nozzle into the larger diameter pipe produces local flow and pressure fluctuations. These fluctuations are generally of low amplitude, however when the detectable signal is low they may interfere with signal detection. The pressure fluctuations decline with distance from the orifice—as only the cross-sectional average of the local pressure fluctuations is capable of propagation at the frequencies of interest, the characteristic length scale of decline being the pipe diameter. Thus, according to a preferred embodiment of the invention the pressure sensor should be located at least 12 pipe diameters downstream of the reflector. According to a more preferred embodiment, it is located at least 60 pipe diameters downstream. In one arrangement, the pressure sensor located at about 75 diameters downstream of the reflector has yielded good results. In FIG. 3, the pipe diameter downstream of reflector 110 is shown with reference letter d, and the distance between pressure sensor 92*c* and reflector 110 is shown with reference letter x.

The distance between the downstream sensors, shown in FIG. 3 with the reference letter y, is preferentially at least a quarter wavelength at the dominant frequency of telemetry.

Figure 4:
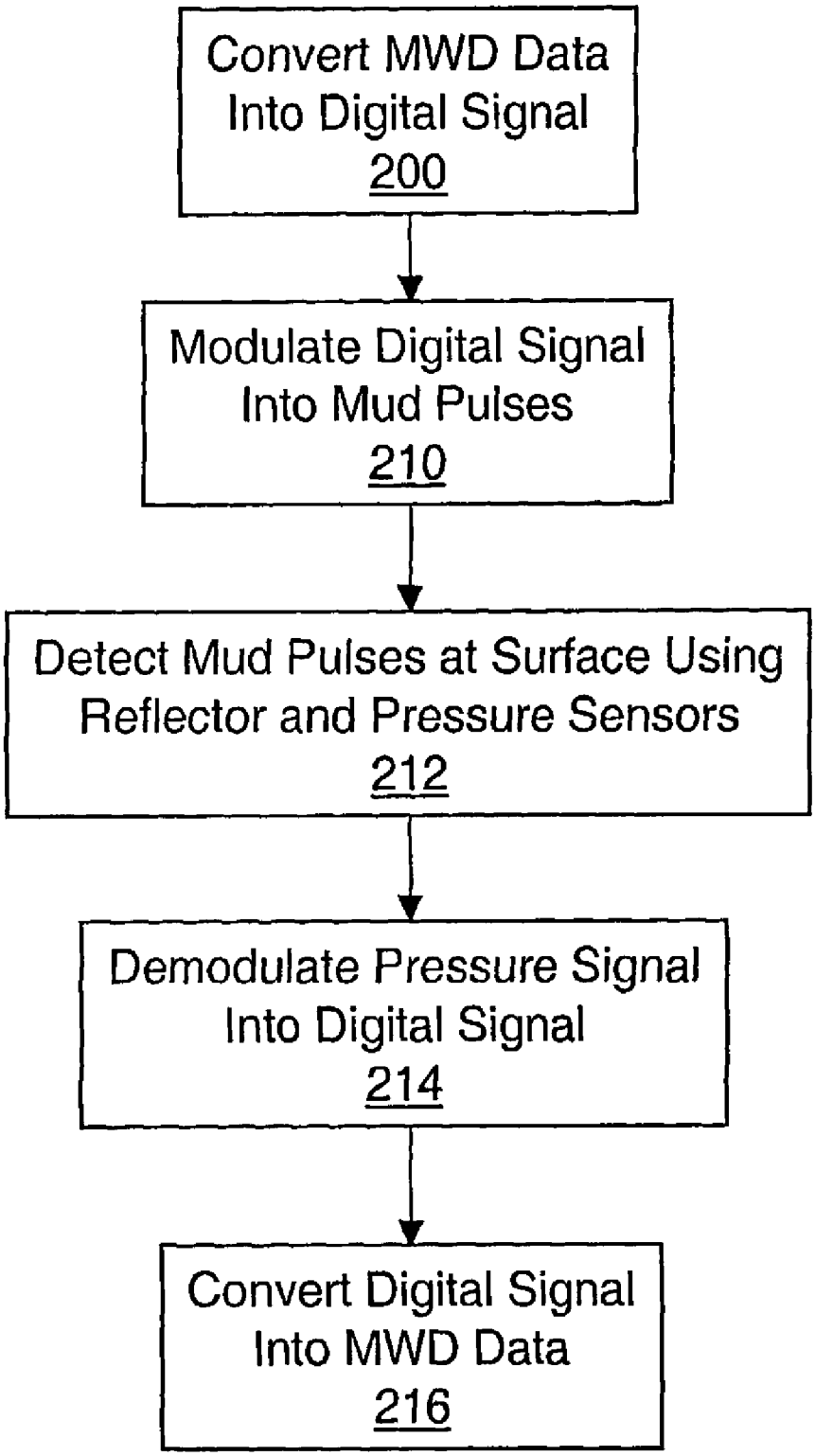
FIG. 4 is a flow chart showing steps in a preferred method of telemetry during drilling, according to the invention.

FIG. 4 is a flow chart showing steps in a preferred method of telemetry during drilling, according to the invention. In step 200 the MWD data as measured in the bottom hole assembly are converted into digital signals. In step 210 the digital signal is modulated into mud pulses. The mud pulses are generated by a pulser assembly as shown in FIG. 1. The mud pulses travel up the drill pipe towards the surface. At the surface, in step 212 the mud pulses are detected by a pressure sensor located below a suitable reflector as described in FIG. 3. In step 214 the pressure signal from the pressure sensor is demodulated into a digital signal. In step 216 the digital signal is converted back into the MWD data.

Figure 6:
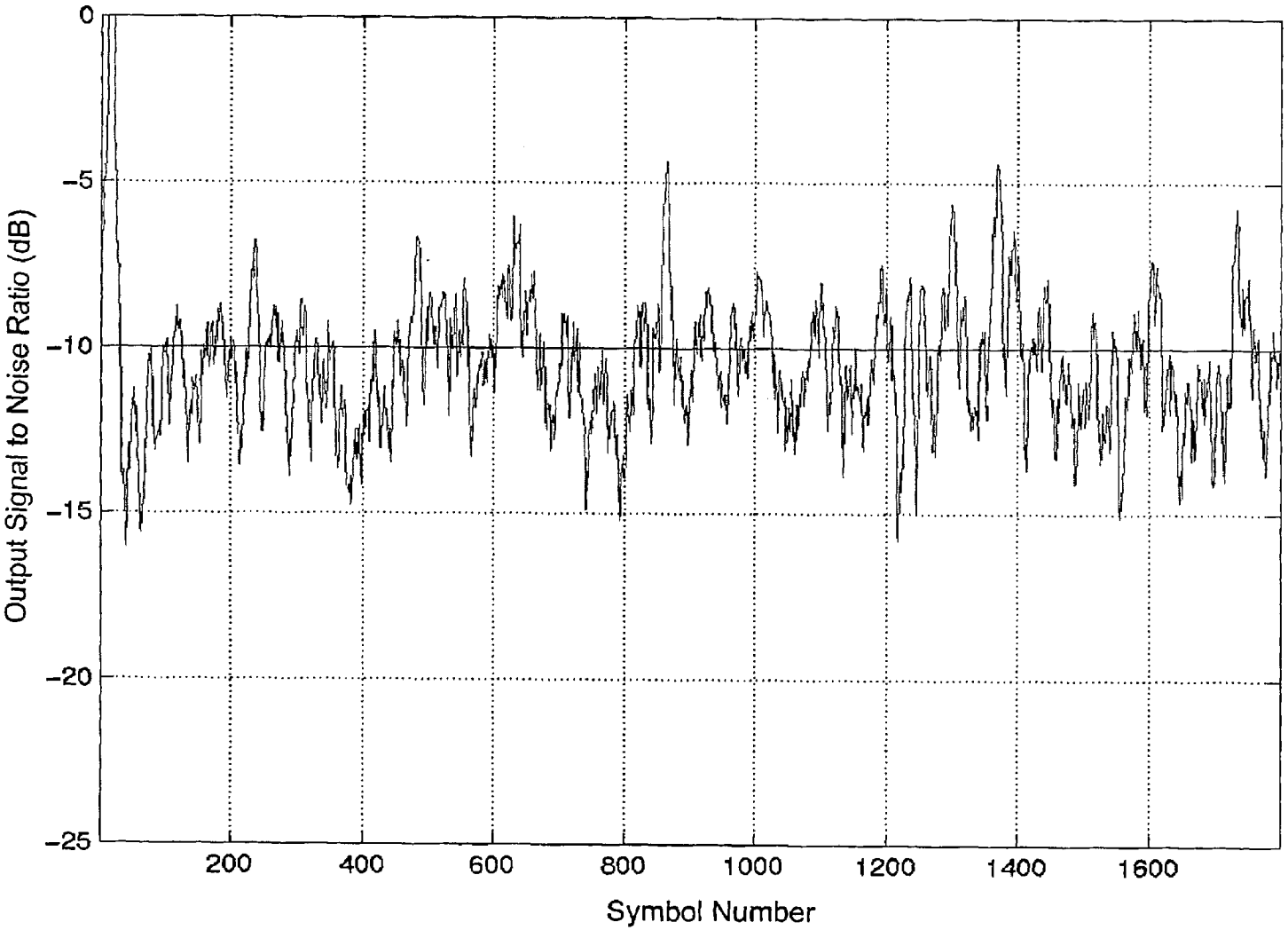
Figure 6 (Prior Art)
FIG. 6 shows an example of the output signal to noise ratio of a mudpulse telemetry signal measured using conventional techniques.
Figure 7:
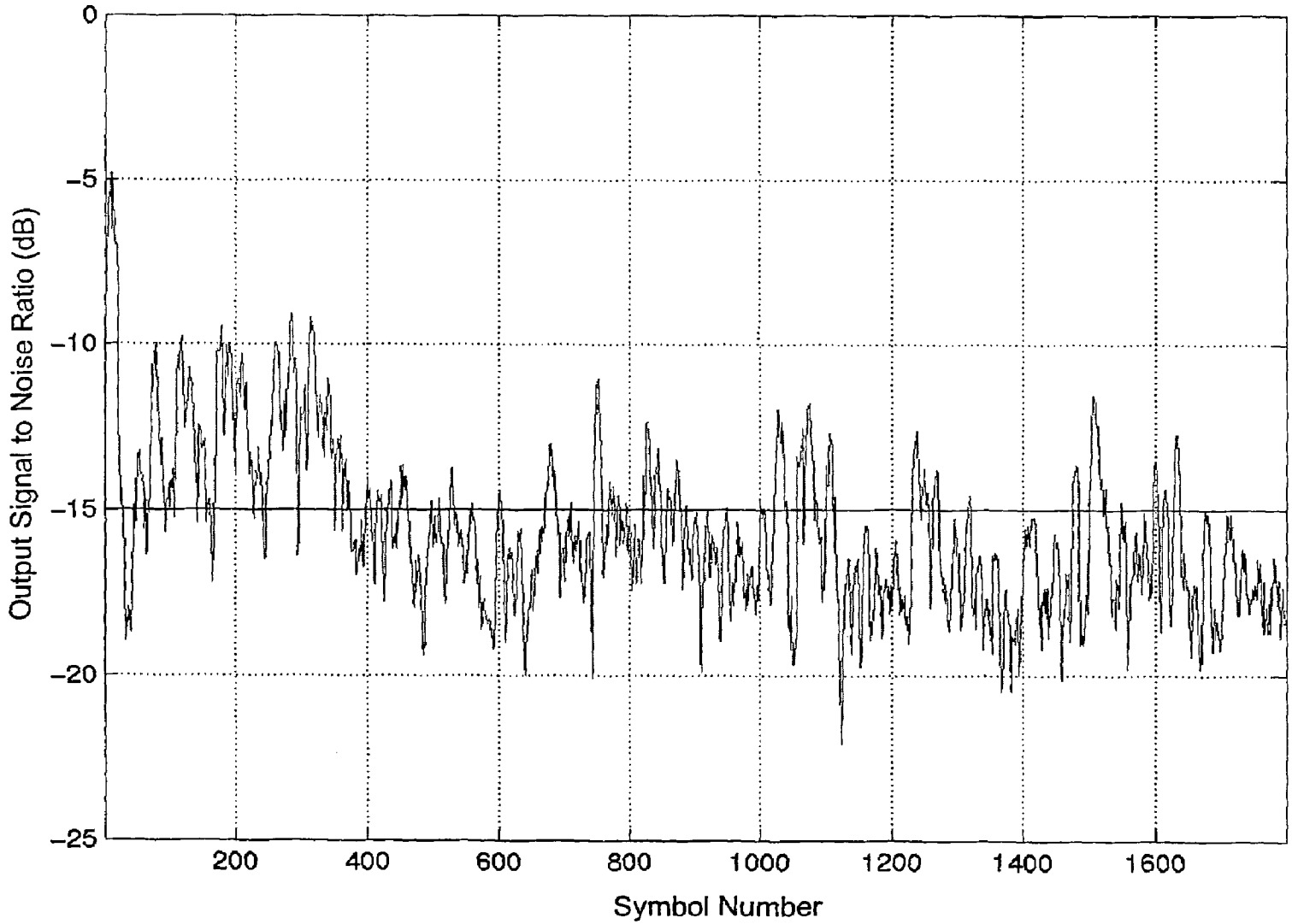
FIG. 7 shows an example of the output signal to noise ratio of a similar mudpulse telemetry signal measured according to a preferred embodiment of the invention.

FIG. 6 shows an example of the output signal to noise ratio of a mudpulse telemetry signal measured using conventional techniques. In comparison, FIG. 7 shows an example of the output signal to noise ratio of a similar mudpulse telemetry signal measured according to a preferred embodiment of the invention. The vertical axis is output signal to noise ratio, and the horizontal axis is the detected symbol number. Note that along much of the range of detected symbols, there is a substantial improvement, of about a 4 dB, in the signal to noise ratio shown in FIG. 7. The conditions used for taking the measurements as shown in FIGS. 6 and 7 are as follows. The pipe diameter is 3.5 inches (8.9 cm). One sensor was used, which was located about 90 feet downstream of the reflector. The reflector, in the case of FIG. 7, is an orifice plate comprising three nozzles having diameters of 18, 12, 10 32ths of an inch (1.4, 1.0, and 0.8 cm, respectively). The pressure drop across the reflector under the flow conditions used was 580 psi (4.0 MPa). The value of $\lambda_l$ under these conditions is approximately 1.5. The proportion of energy absorbed by the reflector under these conditions is approximately 50%.

While preferred embodiments of the invention have been described, the descriptions are merely illustrative and are not intended to limit the present invention.

What is claimed is:

1. A borehole communication system for telemetry through a drilling fluid comprising:

a drilling fluid source configured to supply drilling fluid under pressure through a conduit towards a drill bit;

a pulser in the borehole configured to generate pressure pulses in the drilling fluid corresponding to a predetermined pattern;

a reflector positioned downstream from the drilling fluid source dimensioned so as to cause in response to an incident pressure wave travelling from the pulser towards the surface, a reflected pressure wave having the same pressure polarity as the incident pressure wave; and a pressure sensor positioned downstream of the reflector adapted to sense pressure in the drilling fluid and generate electrical signals corresponding to the sensed pressure.

2. The system according to claim 1 wherein the conduit includes a drill string and surface conduits.

3. The system according to claim 2 wherein the pulser is located in a bottom hole assembly in the vicinity of the drill bit.

4. The system according to claim 1 further comprising a processor in electrical communication with the pressure sensor adapted to demodulate the electrical signals generated by the pressure sensor.

5. The system according to claim 1 wherein the energy of an incident pressure wave absorbed by the reflector is greater than 20%.

6. The system according to claim 5 wherein the energy of an incident pressure wave absorbed by the reflector is greater than 30%.

7. The system according to claim 6 wherein the energy of an incident pressure wave absorbed by the reflector is greater than 40%.

8. The system according to claim 1 wherein the reflector has a value of $\lambda_l$ of greater than about 0.25.

9. The system according to claim 8 wherein the reflector has a value of $\lambda_l$ of greater than about 0.5

10. The system according to claim 9 wherein the reflector has a value of $\lambda_l$ of greater than about 1.

11. The system according to claim 1 wherein the reflector is a fixed orifice plate.

12. The system according to claim 1 wherein the reflector comprises an adjustable aperture.

13. The system according to claim 1 wherein the pressure sensor is positioned on the conduit downstream of the reflector at a distance of more than about 12 times the diameter of the conduit from the reflector.

14. The system according to claim 13 wherein the pressure sensor is positioned more than about 60 times the diameter of the conduit from the reflector.

15. The system according to claim 1 further comprising:

an upstream pressure sensor located upstream from the reflector; and a processor in communication with said pressure sensor and said upstream pressure sensor and adapted to combine signals from the sensors so as to improve signal to noise ratio.

16. The system according to claim 15 further comprising a second downstream pressure sensor in communication with said processor, wherein the processor is adapted to combine signals from said pressure sensor, said second downstream pressure sensor, and said upstream pressure sensor so as to improve signal to noise ratio.

17. The system according to claim 1 further comprising:

a second downstream pressure sensor located downstream from the reflector; and a processor in communication with said pressure sensor and said second downstream pressure sensor and adapted to combine signals from the sensors so as to improve signal to noise ratio.

18. The system according to claim 17 wherein the distance between said pressure sensor and said second downstream pressure sensor at least about a quarter wavelength at a dominant frequency of telemetry.

19. A method for detecting telemetry signals travelling from a downhole source towards the surface through a drilling fluid comprising the steps of:

reflecting incident pressure waves in the drilling fluid travelling towards the surface, thereby generating reflected pressure waves having the same pressure polarity as the incident pressure waves; and sensing the pressure of the drilling fluid at a location downstream of where the reflections are generated.

20. The method of claim 19 wherein the pressure is sensed using a pressure sensor, and the method further comprising the step of demodulating electrical signals generated by the pressure sensor using a processor in electrical communication with the pressure sensor.

21. The method of claim 19 wherein the energy of an incident pressure wave absorbed during reflection is greater than 20%.

22. The method of claim 21 wherein the energy of an incident pressure wave absorbed during reflection is greater than 40%.

23. The method of claim 19 wherein a reflector is used to generate the reflections, the reflector having a value of $\lambda_l$ of greater than about 0.25.

24. The method of claim 23 wherein the reflector has a value of $\lambda_l$ of greater than about 1.

25. The method of claim 19 wherein an adjustable aperture is used to generate the reflections.

26. The method of claim 19 wherein a reflector is used to generate the reflections, and the pressure is sensed at a location in a conduit located downstream at a distance of more than about 12 times the diameter of the conduit from the reflector.

27. The method of claim 26 wherein the pressure is sensed at a position more than about 60 times the diameter of the conduit from the reflector.

28. The method according to claim 19 further comprising the steps of:

sensing the pressure of the drilling fluid at a location upstream of where the reflections are generated; and combining signals representing the pressures sensed at the location downstream and the location upstream so as to improve signal to noise ratio.

29. The method according to claim 28 further comprising the step of sensing the pressure of the drilling fluid at a second downstream location, wherein the step of combining signals comprises combining signals representing pressure sensed at the location upstream, the location downstream, and the second location downstream so as to improve signal to noise ratio.

30. The method according to claim 19 further comprising:

sensing the pressure of the drilling fluid at a second location downstream of where the reflections are generated; and combining signals representing the pressures sensed at the location downstream and the second location downstream so as to improve signal to noise ratio.

31. The method according to claim 30 wherein the distance between said downstream location and said second downstream location is at least about a quarter wavelength at a dominant frequency of telemetry.

* * * * *